US005960832A

United States Patent [19]

Warshawsky

[11] Patent Number: 5,960,832

[45] Date of Patent: Oct. 5, 1999

[54] ZINC-BASED SPRAY FAUCET HOSE COLLAR WEIGHT

[75] Inventor: Jerome Warshawsky, Hewlett Harbor, N.Y.

[73] Assignee: I.W. Industries, Inc., Melville, N.Y.

[21] Appl. No.: 09/105,879

[22] Filed: Jun. 26, 1998

Related U.S. Application Data

[63] Continuation of application No. 08/248,521, May 24, 1994, Pat. No. 5,771,934.

[51] Int. Cl.[6] ..... E03C 1/04

[52] U.S. Cl. ..... 137/801

[58] Field of Search ..... 137/801

[56] References Cited

U.S. PATENT DOCUMENTS

| | | | |
|---|---|---|---|
| 3,739,456 | 6/1973 | Scherer et al. . | |
| 3,891,530 | 6/1975 | Alewitz . | |
| 4,487,230 | 12/1984 | Anthony . | |
| 4,827,538 | 5/1989 | Heimann et al. . | |
| 5,090,062 | 2/1992 | Hochstrasser . | |
| 5,361,431 | 11/1994 | Frier et al. . | |
| 5,588,248 | 12/1996 | Cornell et al. | 43/43.1 X |
| 5,771,934 | 6/1998 | Warshawsky | 137/801 |

OTHER PUBLICATIONS

Paige, J. et al. "Leachability of Lead from selected Cooper–Based Alloys", Corrosion (ISSN 0010–9312) V. 48. pp. 1040–1046 Dec. 1992.

Samuels, E.R. et al., "Preliminary Studies on the Leaching of Some Trace Metals from Kitchen Faucets", Water Research (ISSN 0043–1354), vol. 18. No. 1. pp. 75–80. 1994.

Schott, Tim. "Bathroom Sinks and Faucets", Custom Builder (ISSN 0895–2493) vol. 5, pp. 36–43, Mar. 1990.

Lexis database printout for patents related to lead leaching in pipes.

Masco Corp. 1984 "Weight–Hose–Lead" one page assembly drawing.

American Die Casting Institute, Inc. 1977, "An Introduction to Die Castings" pp. 1 and 2.

*Primary Examiner*—Gerald A. Michalsky
*Attorney, Agent, or Firm*—Alfred M. Walker

[57] ABSTRACT

A collar weight for securing hand held spray faucet hoses therethrough is provided, wherein the collar weight is made of a composition including a zinc-based alloy to replace the use of lead in the collar weight, to prevent leaching of lead from the collar weight. To maintain the hose in an untangled position beneath the surface of a sink, the collar weight is strategically placed along an arcuate surface of the hose to weigh down the hose at approximately the midpoint of the hose. The collar weight includes a top half collar portion and a lower half collar portion, which are joinable at respective inner edges thereof by fastening means, such as screws, to provide a generally hollow longitudinally extending bore for insertion of the hose therein.

4 Claims, 3 Drawing Sheets

ZINC-BASED SPRAY FAUCET HOSE COLLAR WEIGHT

This application is a continuation of application Ser. No. 08/248,521, filed May 24, 1994, now U.S. Pat. No. 5,771, 934.

FIELD OF THE INVENTION

The present invention relates to a weight which can be used for reinforcing hoses for hand held spray faucets in a proper position beneath a sink.

More particularly, the present invention relates to collar weight elements for securing spray faucet hoses, wherein the use of a zinc-based alloy minimizes the use of lead and prevents leaching of lead from the collar weight elements.

BACKGROUND OF THE INVENTION

Traditionally, collar weights for hand held spray faucets hold down a flexible hose in a proper position for ease of moving and using the hand held faucet attached to the hose. Such conventional hose weights utilize an alloy of primarily lead, since lead is a very heavy metal, which can minimize the volume of metal required to provide a weight for maintaining a lightweight hose connected to a hand held spray faucet, in an untangled position below a sink.

However, the use of lead for such weight articles has been found to be harmful since there is a tendency for the lead to leach out of the hose weight and come into contact with humans.

Other metals present problems which detract from their use as suitable weights for spray faucet hoses in the humid environment below a sink surface. For example, steel has a tendency to rust in a humid environment, such as below a sink surface, and rust resistant stainless steel weights are expensive to manufacture. On the other hand, rust resistant metals such as aluminum are too lightweight to provide an adequate weight, without being an unreasonably large size.

The spray faucet hose weight of the present invention preferably includes a composition including a zinc alloy, which may contain additional alloying elements in varying amounts. The term "zinc alloy" refers to an alloy substantially of zinc; the composition of which can also include other metals in varying, though lesser, amounts. The zinc content of the composition should preferably be about 95% by weight.

As a result, the weight of the present invention provides an adequate rustproof anti-gravity weight without a large increase in volume of size for the weight.

DESCRIPTION OF THE PRIOR ART

The practice of using a lead-based weight for spray faucets is widespread and well known to the art. In fact, it has been acknowledged that the use of the lead is severely affected by humidity, aging and related effects causing degradation and involving heat corrosion.

Such problems of leachability of lead as discussed in Paige, J. et al, "Leachability of Lead from Selected Copper-Based Alloys", *Corrosion* (ISSN 0010-9312) V.48, p. 1040–6, Dec. 6, 1992, Lytle, Darren A. et al, "Investigating the Preferential Dissolution of Lead from Solder Particulates", *Journal American Water Works Association* (ISSN 0003-150X) V. 85, p.104–110, July 1993, and Lee, Ramon et al, "Lead at the Tap Sources and Control", *Journal of American Water Works Association* (ISSN-0003-150X) V. 81, p. 52–62, July 1989.

The present invention is intended to overcome the foregoing disadvantages and other drawbacks inherent in prior art devices.

OBJECTS OF THE INVENTION

Accordingly, it is an object of the present invention to provide a novel collar weight clamp for a hand held spray faucet.

It is yet another object of the present invention to provide a novel composite zinc weight for spray faucet hoses.

It is a further object of the present invention, to provide a weight for spray faucet hoses including a zinc alloy.

It is yet another object to provide a weight for a spray faucet which includes a dual portion collar which is easily assembled upon a flexible hose for a hand held spray faucet.

It is yet another object to provide a zinc alloy weight, which has an improved resistance to degradation when exposed to moisture.

It is, therefore, an object of the present invention to provide a novel spray faucet hose weight which affords greater safety and avoids the drawbacks existing in prior art weights.

SUMMARY OF THE INVENTION

The foregoing and related objects are achieved by the present invention which provides a weight for spray faucet hoses comprising a zinc alloy containing approximately 95% zinc by weight including other metal alloy components such as, for example, copper and aluminium and minimal trace amounts of magnesium, iron, lead, cadmium, tin, titanium and/or chromium. The weight may be a single composite of zinc.

The zinc based collar weight is a two piece clamp produced from the zinc alloys and can be incorporated into a spray faucet hose.

The spray faucet hose weight of the present invention is preferably constructed as a dual piece collar which when assembled has an inner cylindrical bore therethrough. When fitted on the hose, it is able to be secured around a flexible spray faucet hose having a diameter of approximately 14 mm. Moreover, the fully constructed spray faucet weights approximately 0.6 lb for best results.

The weight of the present invention is mounted upon the hose of a hand held spray faucet, which faucet is used by a consumer when water is diverted through the hose from a water intake valve of a conventional faucet to the hand held spray faucet head.

Since the hose must be movable in conjunction with the hand held spray faucet, the hose is generally made of a flexible, lightweight material, such as rubber or a reinforced elastomeric material. Because the hose is lightweight, without a counter balancing weight to hold the hose down at its midpoint, the hose tends to tangle under the sink, and interfere with the smooth return of hand held spray faucet to its resting position upon a kitchen sink. To keep the hose in an untangled position beneath the surface of the sink, the weight is strategically placed approximately midway along the length of the hose between the hand held spray faucet at one end of the hose and the water intake valve in at an opposite end of the hose.

The weight for the hose also prevents the hand held spray faucet from exiting too far beyond a predetermined distance above the surface of the sink, when the hand held spray faucet is moved up from the sink.

To assemble the weight upon the hose, the collar weight is provided in two parts, an upper half and a lower half, which two parts are fastened at their respective inner edges by screws or the like. The two halves of the collar are joined together, thus surrounding the hose, which extends longitudinally therethrough.

To further stabilize the collar weight, the collar weight is shaped with a weight distribution with the largest portion at the center, with the collar weight tapering toward the opposite ends of the collar weight.

The lower half of the collar weight includes a pair of indented recess for insertion of fasteners therein.

To facilitate the turning of fasteners, such as screws, by tightening, the recesses are provided with a concave inner wall.

The recesses also prevent fasteners from protruding outward from the surfaces of lower collar portion.

A preferred example of the material composition for the zinc based composite collar weight is known commercially as ZAMAK® which is made of approximately 95% zinc, 4% aluminium and traces of other metals, such as copper, magnesium, iron, lead, cadmium, tin, titanium and chromium.

The Zamak® material has an ultimate tensile strength KSI of 41, a percentage elongation in 2 inches of about 10%, and a hardness as measured by Brinell @500 kg. of about 82.

The advantage of the collar weight using a zinc based alloy, instead of a lead based alloy, is that the selected zinc alloy does not leach a discernable amount of lead, thus substantially preventing lead flakes and lead particles from leaching from the collar weight upon exposure to air and humidity. This provides an improved resistance of the collar weight to deterioration by humidity.

In addition, the structural configuration of the collar weight provides for easy installation of the collar upon the hose of a hand held spray faucet head.

DESCRIPTION OF THE DRAWINGS

The present invention may be best understood when seen in conjunction with the drawings, in which.

DETAILED DESCRIPTION OF THE INVENTION

As shown in FIGS. 1–5, collar weight 1, preferably made from a zinc alloy, includes a two piece clamp, which collar weight 1 can be assembled over spray faucet hose 2 for reinforcing spray faucet hose 2 within a desired position beneath sink 7.

More particularly, collar weight 1 for securing spray faucet hose 2 uses a zinc-based alloy to minimizes the use of lead. As noted, the use of lead for weights may be harmful because of the tendency for lead to leach out of and flake off of a hose weight and therefore come into contact with humans reaching below sink 7.

Although collar weight 1 for spray faucet hose 2 includes preferably a zinc alloy containing approximately 95% zinc by weight and optionally a separate outer film of a metal or metal alloy, collar weight 1 may be a single composite zinc.

Spray faucet hose collar weight 1 of the present invention is preferably constructed as a dual portion which includes a longitudinally extending inner bore 31–32. Collar weight 1 is fitted over hose 2, which hose 2 has generally a diameter of 14 mm.

Moreover, spray faucet collar weight 1 weighs approximately 0.6 lb for best results. The zinc alloy constituting faucet hose collar weight 1 preferably includes additional alloying elements in varying amounts. The term "zinc alloy" refers to an alloy substantially of zinc; the composition of which can also include other metals in varying, though lesser, amounts. The zinc content of the composition should preferably be about 95% by weight.

Figure 1:
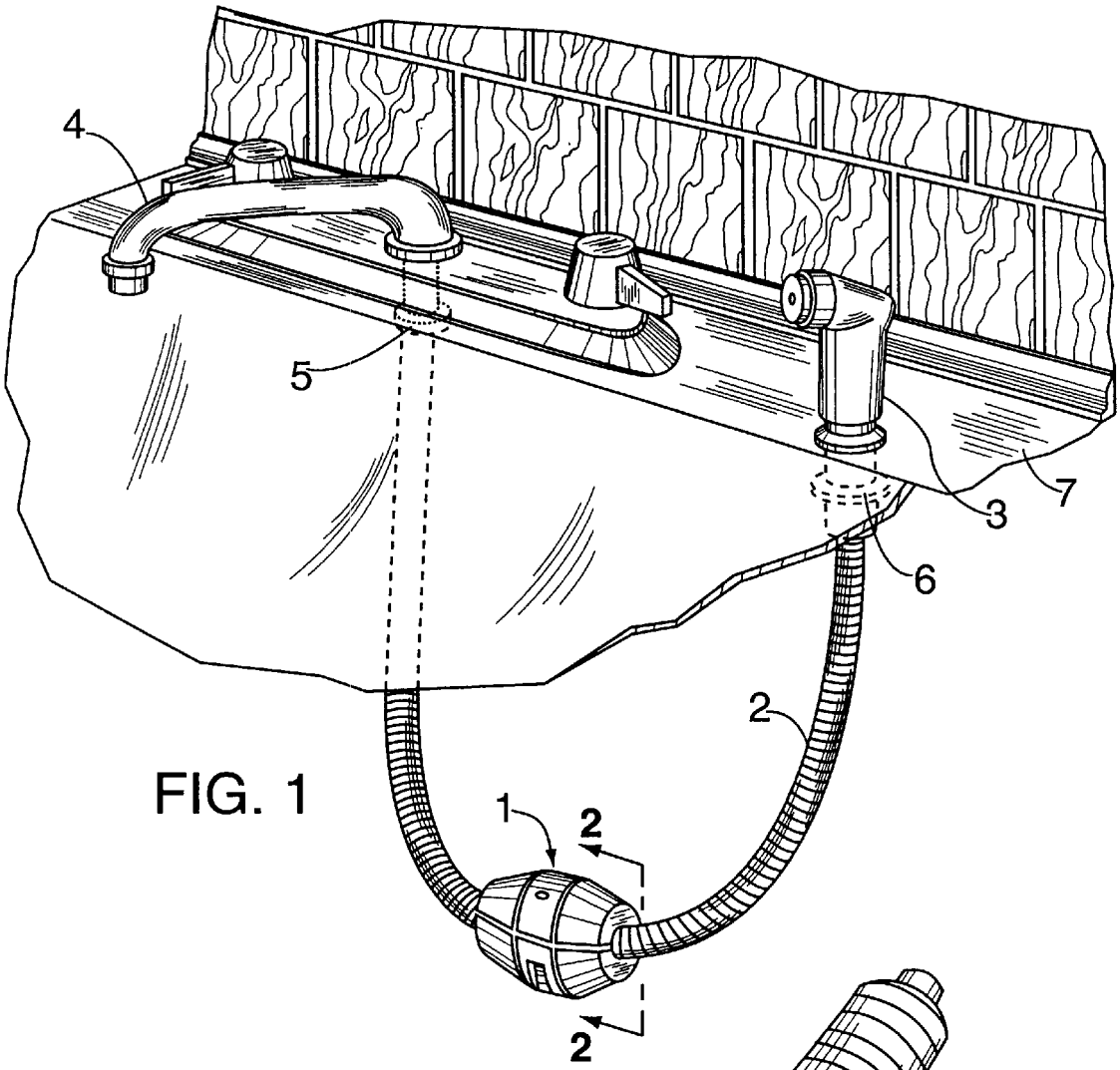
FIG. 1 is a perspective view of the collar weight of the present invention, shown mounted upon a hose for a hand held spray faucet.

Turning especially to the particular drawing FIGS. 1–5, as shown in FIG. 1, collar weight 1 of the present invention is shown mounted upon hose 2 for hand held spray faucet 3. Water is diverted through hose 2 from water intake valve 5 of conventional faucet 4 to hand held spray faucet 3.

Because hose 2 must be movable in conjunction with hand held spray faucet 3 through sink bore 6 of sink 7, hose 2 is generally made of a flexible, lightweight material. However, because hose 2 is lightweight, it tends to tangle and interfere with the smooth return of hand held spray faucet 3 to bore 6 within sink 7.

To maintain hose 2 in an untangled position beneath the surface of sink 7, collar weight 1 is strategically placed over the surface of hose 2, to weigh down hose 2 at approximately the midpoint of hose 2, between hand held spray faucet 3 at one end and water intake valve 5 in the vicinity of conventional faucet 4 at an opposite end.

Moreover, the position of collar weight 1 upon hose 2 provides a stop means to prevent hose 2 from exiting too far beyond a predetermined distance above the surface of sink 7, when hand held spray faucet 3 is removed manually from its position of rest at bore 6 within sink 7, to a desired position of use, in spaced relation above, and away from, sink 7.

Figure 2:
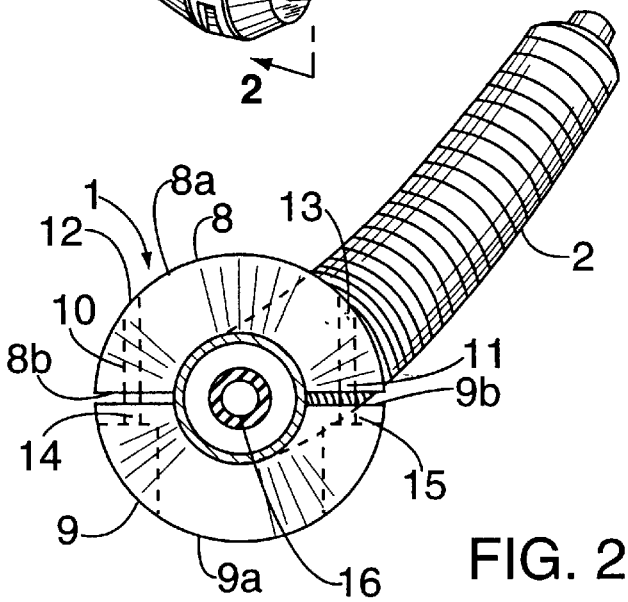
FIG. 2 is a cross sectional view of the collar weight as in FIG. 1, taken along lines 2—2 of FIG. 1.

As shown in FIG. 2, collar weight 1 includes top half collar portion 8 and lower half collar portion 9. Top half collar portion 8 includes a generally convex outer edge 8*a* and a partially concave inner edge 8*b*. Lower half collar portion 9 includes a generally convex outer edge 9*a* and a partially convex inner edge 9*b*. Top half collar portion 8 and lower half collar portion 9 are joinable at their respective inner edges 8*b*, 9*b* by fastening means 10 and 11, such as screws, within upper internal bores 12, 13 of top half collar portion 8, which respective upper internal bores 12, 13 are in positional register with respective lower internal bores 14, 15 of lower half collar portion 9 for insertion of fasteners 10, 11 therethrough, so that top half collar portion 8 and lower half collar portion 9 of collar weight 1 surround hose 2, which hose 2 includes longitudinally extending therein water bearing conduit 16.

Figure 3:
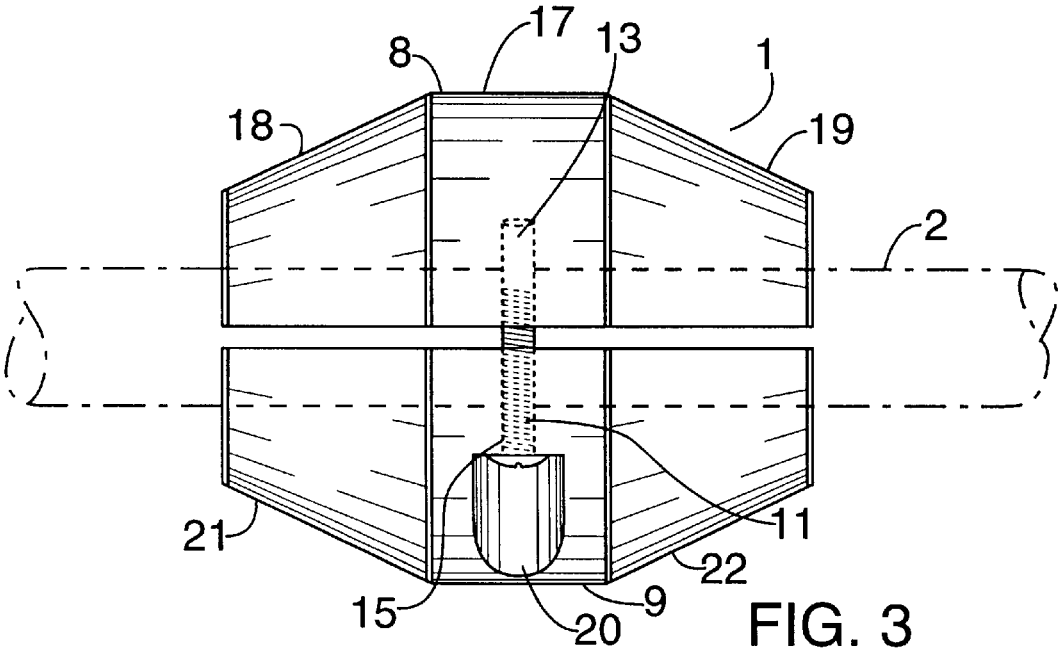
FIG. 3 is a side elevational view of the collar weight as in FIG. 1, with a fastener shown in dotted lines.

As shown in FIG. 3, collar weight 1 includes an upper cylindrical central half portion 17 having extending longitudinally from each opposite end thereof a pair of truncated half conical end pieces 18, 19, which end pieces 18, 19 join with respective lower cylindrical central half portion 20 having extending longitudinally from each opposite end thereof further truncated half conical end pieces 21, 22, to form collar weight 1 surrounding hose 2 therethrough.

Figure 4:
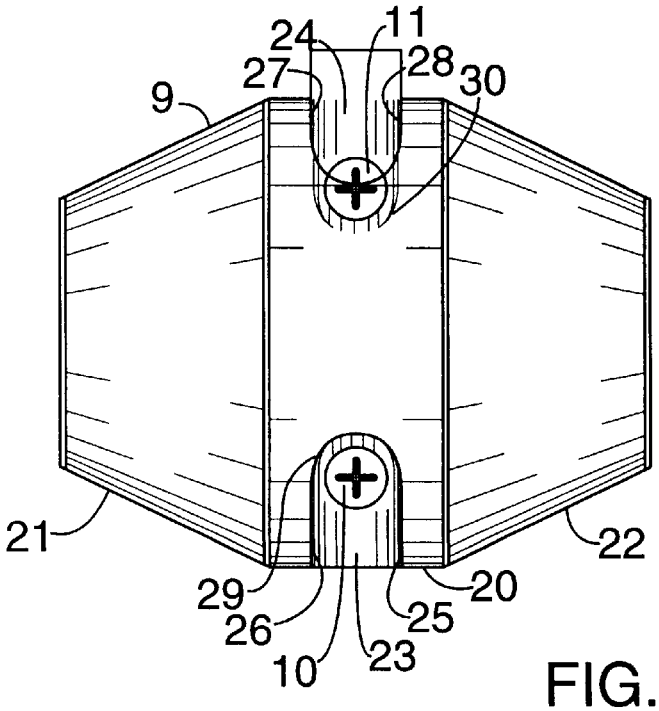
FIG. 4 is a bottom plan view of the collar weight as in FIG. 1.

As shown in FIG. 4, lower half collar portion 9 includes indented recess 23 between walls 25, 26 for insertion of fastener 10 therebetween, and further indented recess 24 between walls 27, 28 for insertion of fastener 11 therebetween.

To accommodate the insertion of fasteners 10, 11 within bores 14, 15 of lower half collar portion 9, end walls 29, 30 of respective recesses 23, 24 are concave, to facilitate the turning of fasteners 10, 11 by tightening motions, such as rotatable screwing of fasteners 10, 11.

Recesses 23, 24 also prevent fasteners 10, 11 from protruding above the surfaces of lower collar portion 9, thereby interfering with manual grasping of collar weight 1 when installed over hose 2.

Figure 5:
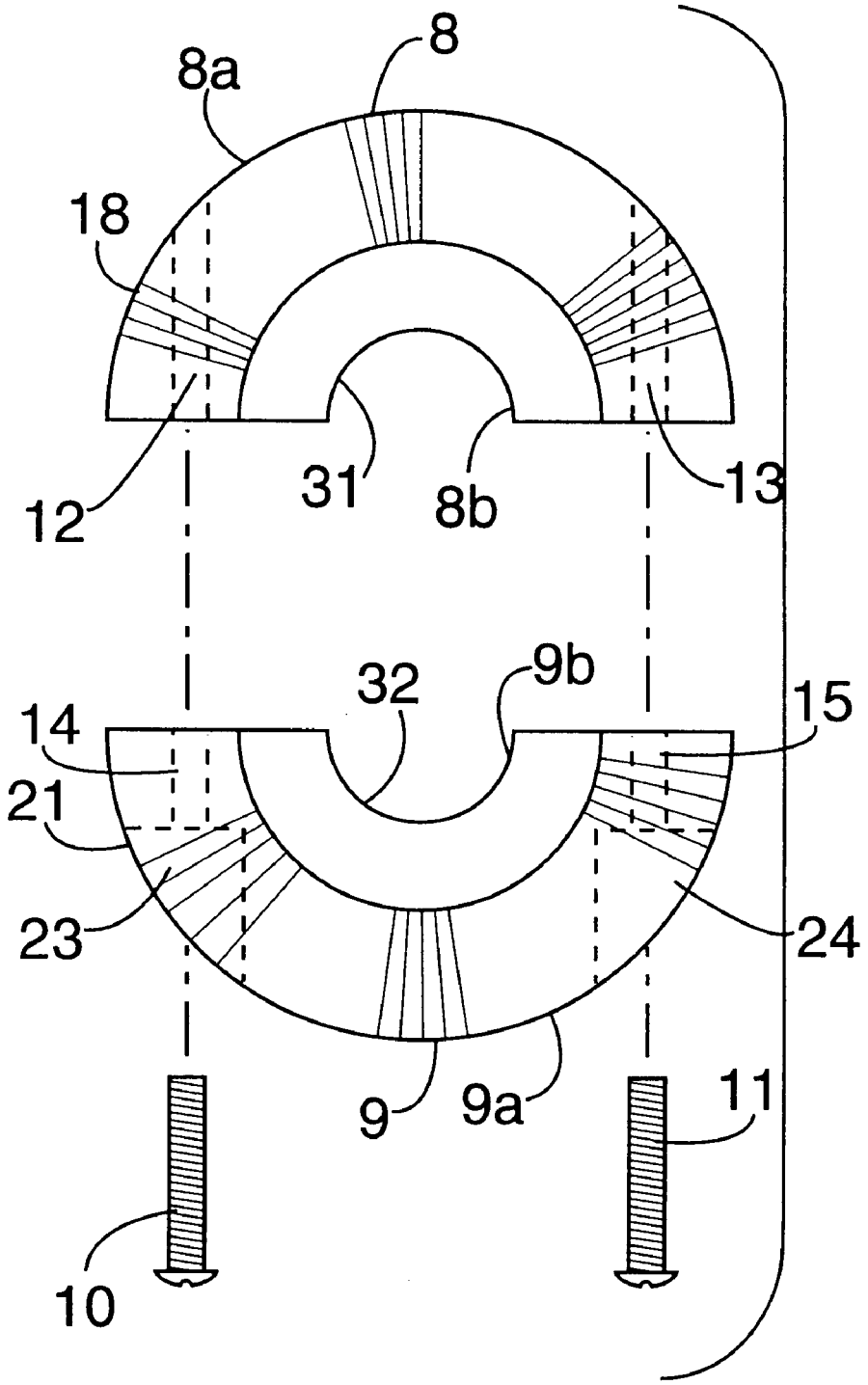
FIG. 5 is an exploded front view of the collar weight as in FIG. 1.

As shown in FIG. 5, top half collar portion 8 includes at its inner surface a first half cylindrical recess 31, which half cylindrical recess 31 mates with further half cylindrical recess 32 to provide longitudinally extending cylindrical bore 31–32 for insertion of hose 2 therethrough.

The preferred embodiment of the metal collar weight 1 constituting an alloy of zinc is derived from what is known commercially as ZAMAK®3, having the following properties:

| Component | ZAMAK ® 3 |
|---|---|
| Copper | 0.0–0.10 |
| Aluminum | 0.0–3.9–4.3 |
| Magnesium | 0.0–.05 |
| Iron | 0.0–0.75 |
| Lead | 0.0–.004 |
| Cadmium | 0.0–.003 |
| Tin | 0.0–.002 |
| Titanium | 0.0–.001 |
| Chromium | 0.0–.001 |
| Zinc | about 95.00 |

The amount of lead used in collar weight 1 is minimal, so that no discernable leaching of lead is observable.

As a result, collar weight 1 has the advantage over lead based weights, in that most of the selected metal alloy does not leach lead particles.

Other modifications may be made to the present invention without departing from the scope of the present claims.

I claim:

1. A collar weight used for securing, and in combination with, a flexible hand-held spray faucet hose in an untangled position beneath a sink, comprising:

said collar weight mounted on said hose;

said collar weight comprises a composition of a zinc based alloy wherein said zinc based alloy is provided in an amount of about 95 percent by weight;

said collar weight having an upper portion and a lower portion mounted on opposite sides of said hose, each portion having a curved surface in continuous contact with the outer surface of said hose;

said upper portion having a pair of oppositely extending flat surfaces extending out from the curved surface of said upper portion;

said lower portion having a pair of oppositely extending flat surfaces extending out from the curved surface of said lower portion, the outwardly extending flat surfaces of said upper and lower portions being spaced apart and facing each other;

said upper portion and lower portion being joined together by a plurality of threaded surfaces, each said portion having at least one bore to threadably receive a fastener therethrough.

2. The zinc alloy as in claim 1, further comprising at least one additional metal selected from the group consisting of copper, magnesium, iron, lead, cadmium, tin, titanium, and chromium, in a percentage by weight of 1 percent by weight or less.

3. The collar weight as in claim 1, wherein said zinc based alloy includes a composition with the following components by percentage weights as follows:

| Component | Percentage by weight |
|---|---|
| Copper | 0.0–0.10 |
| Aluminum | 0.0–3.9–4.3 |
| Magnesium | 0.0–.05 |
| Iron | 0.0–0.75 |
| Lead | 0.0–.004 |
| Cadmium | 0.0–.003 |
| Tin | 0.0–.002 |
| Titanium | 0.0–.001 |
| Chromium | 0.0–.001 |
| Zinc | about 95.00 |

4. A collar weight assembly for reinforcing and in combination with a hand-held spray faucet hose in a desired position below a sink comprising:

a flexible hand-held faucet hose;

said collar weight for securing said spray faucet hose, comprising a zinc based alloy, of about 95 percentage weight of zinc;

said collar weight further including a two piece clamp, said collar weight being mountable over the spray faucet hose for reinforcing the spray faucet hose within a desired position beneath a sink;

a means for preventing the tangling of the hose beneath the sink, said means being said collar weight being placed along an arcuate surface of hose at approximately a midpoint of the hose between a faucet end and an opposite water intake valve;

said collar weight having a first upper portion and a further lower portion;

said first upper portion having an outer edge and an inner edge;

said further lower portion having a further outer edge and a further inner edge;

said first upper portion joinable at said inner edge to said further inner edge of said further lower portion, said collar weight having a longitudinally extending bore therethrough for insertion of the flexible spray hose therethrough;

said first upper collar portion and said further lower collar portion joinable at said respective inner edges thereof by first and second fasteners insertable within upper internal transverse bores of said first upper collar portion, said first upper collar portion having at least one internal transverse bore, said internal transverse bore being in positional register with at least one lower internal transverse bore of said lower collar portion for insertion of said at least one fastener therethrough, said first upper collar portion and said lower collar portion surrounding said hose, said collar portions being spaced from each other thereby exposing a portion of the outer surface of said hose and said fastener;

said first upper portion including an upper cylindrical central half portion at said inner edge thereof, said upper cylindrical central half portion having extending longitudinally from each opposite end thereof a truncated half conical end piece;

said further lower portion including a lower cylindrical central half portion at said inner edge thereof, said lower cylindrical central half portion having extending longitudinally from each opposite end thereof a further truncated half conical end piece;

said lower half collar portion including a first indented recess between a pair of walls for insertion of said first fastener therebetween, and a further indented recess between said walls for insertion of said second fastener therebetween; and each of said first and said further recesses having concave end walls to facilitate the turning of said first and second fasteners.

* * * * *